US005504952A

United States Patent [19]

Ovadia

[11] Patent Number: 5,504,952

[45] Date of Patent: Apr. 9, 1996

[54] BED HAVING USER VARIABLE DEGREE OF HARDNESS

[76] Inventor: Shmuel Ovadia, 19 Lobetkin, Tel Aviv, Israel

[21] Appl. No.: 179,279

[22] Filed: Jan. 10, 1994

[30] Foreign Application Priority Data

Jun. 13, 1993 [IL] Israel ..... 106001

[51] Int. Cl.[6] ..... A47C 23/06

[52] U.S. Cl. ..... 5/236.1; 5/481; 5/464

[58] Field of Search ..... 5/464, 481, 236.1, 5/237, 238, 191

[56] References Cited

U.S. PATENT DOCUMENTS

| | | | |
|---|---|---|---|
| 160,185 | 2/1875 | Hale | 5/236.1 |
| 1,371,362 | 3/1921 | Giese | 5/464 |
| 3,067,438 | 12/1962 | Degen | 5/236.1 |
| 3,553,745 | 1/1971 | Sproll | 5/236.1 |
| 3,842,452 | 10/1974 | Kievits | 5/191 |
| 4,092,751 | 6/1978 | Burkholder et al. | 5/464 |
| 4,213,214 | 7/1980 | Gilhooly | 5/464 |
| 4,424,600 | 1/1984 | Callaway | 5/464 |
| 4,843,666 | 7/1989 | Elesh et al. | 5/464 |
| 4,922,564 | 5/1990 | Thomas | 5/464 |
| 4,999,868 | 3/1991 | Kraft | 5/464 |
| 5,105,488 | 4/1992 | Hutchinson et al. | 5/464 |
| 5,231,717 | 8/1993 | Scott et al. | 5/464 |

FOREIGN PATENT DOCUMENTS

| | | | |
|---|---|---|---|
| 325568 | 7/1989 | European Pat. Off. | 5/236.1 |
| 2005461 | 8/1971 | Germany | 5/191 |
| 2709919 | 9/1978 | Germany | 5/191 |

*Primary Examiner*—Michael J. Milano
*Attorney, Agent, or Firm*—Mark M. Friedman

[57] ABSTRACT

A bed including a base, a mattress overlying the base and apparatus for varying the hardness of the bed to take into account the changing personal circumstances of the user, for example, aging, gaining weight etc. and to compensate for the wear and tear on the mattress. The base includes a generally rectangular frame and a plurality of crosspieces traversing thereacross such that the hardness of the bed is varied by varying the number of crosspieces. The mattress includes a filling in which its hardness is varied by varying the amount of the filling, its components or adjusting the packing density of a composite filling having a foam substrate with a plurality of substantially incompressible marble-size balls embedded therein.

7 Claims, 2 Drawing Sheets

BED HAVING USER VARIABLE DEGREE OF HARDNESS

FIELD AND BACKGROUND OF THE INVENTION

The present invention relates to beds in general and to base and mattress combinations in which the hardness can be varied by the consumer.

A typical consumer purchases a bed only a few times in his lifetime and with time, it is often the case, that the hardness and corresponding degree of support provided by a once comfortable bed is no longer suitable because of his changing circumstances, for example, aging or gaining in weight.

Furthermore, wear and tear on a mattress also has a detrimental effect on its hardness such that, over a period of time, used mattresses often cause or at least aggravate back pain.

Therefore, there is a widely recognized need for, and it would be highly desirable to have, a bed in which its hardness and corresponding degree of support can be readily varied by the consumer.

SUMMARY OF THE INVENTION

According to the present invention, there is provided a bed, comprising: (a) a base; and (b) a mattress overlying said base; the base including a generally rectangular frame, a plurality of crosspieces traversing the frame, wherein the distribution of crosspieces can be varied to vary the hardness of the bed, the frame including C-shaped frame members providing a recess for receiving the ends of the plurality of crosspieces.

According to further features of the bed, the base includes a generally rectangular frame and a plurality of crosspieces traversing thereacross such that the hardness of the bed is varied by varying the number of crosspieces.

According to still further features of the present invention, the mattress includes a filling such that the hardness of the bed is varied by varying the amount of the filling, its components or the packing density of a composite filling having a foam substrate with a plurality of substantially incompressible marble-size balls embedded therein.

According to the present invention, there is also provided a base for a bed, comprising: (a) a generally rectangular frame; and (b) a plurality of crosspieces traversing the frame such that the number of crosspieces can be varied to vary the hardness of the bed. The frame includes C-shaped frame members which have a recess for receiving the ends of crosspieces. The crosspieces have a generally convex shape which has been shown to have back pain alleviating properties.

According to the present invention, there is still further provided a mattress for a bed, comprising: (a) a filling which can be varied to vary the hardness of the mattress; and (b) a covering for covering the filling. The hardness of the mattress can be varied by adding more filling, inserting material of different properties, for example, plyboard, between two sheets of filling or adjusting the packing density of a composite filling having a foam substrate with a plurality of substantially incompressible marble-size balls embedded therein.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
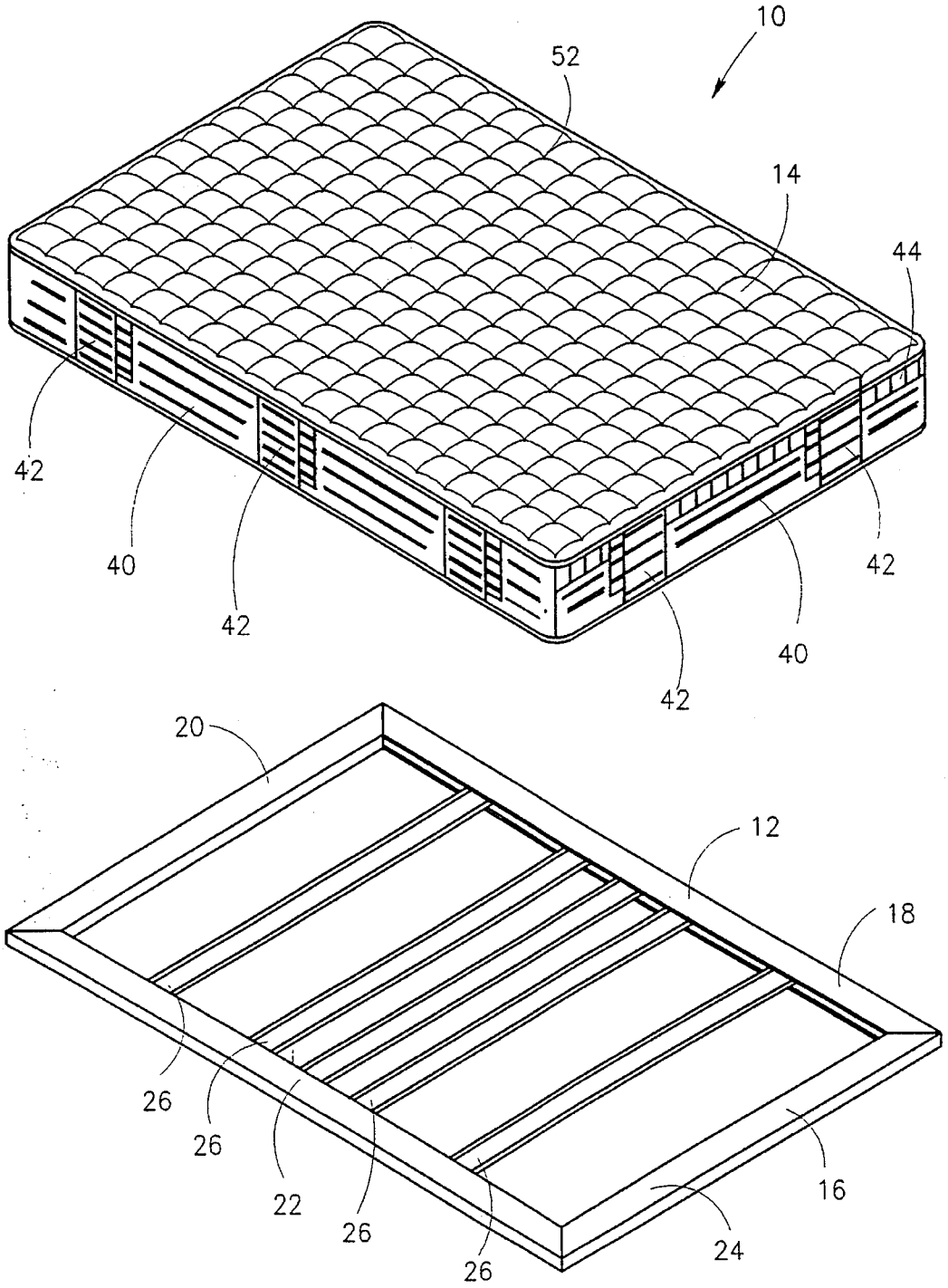
FIG. 1*a* shows a perspective view of a bed according to the present invention.
Figure 1B:
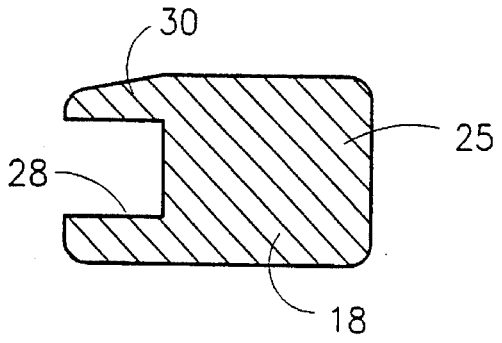
FIG. 1*b* shows a cross-section view of a frame member of the bed.

The present invention is of a bed in which its hardness providing a particular degree of support can be varied by the user over time to take into account his changing circumstances, for example, aging, a gain in weight etc. and to compensate for the normal wear and tear on the bed's mattress. It is believed that a bed having a user variable hardness will facilitate in alleviating lower back pain.

The principles and operation of the bed of the present invention may be better understood with reference to the drawings and the accompanying description.

Referring now to the drawings, FIGS. 1*a*–1*d* illustrate a preferred embodiment of a bed, generally designated 10, constructed and operative according to the teachings of the present invention, generally comprising a base 12 and a mattress 14.

Base 12 comprises a generally rectangular frame 16 including frame members 18-24 and a plurality of crosspieces 26 traversing thereacross. Frame members 18-24 are fashioned from a common generally C-shaped profile 25, best seen in FIG 1*b*, providing a recess 28 for receiving crosspieces 26 and an inclined top face 30 for preventing mattress 14 from sliding on base 12 as the user lies down on bed 10 and gets up therefrom.

Base 12 is designed such that profile 25 and crossmembers 26 can be sold as an off-the-shelf kit which can be easily constructed by a consumer with minimal tools. It should be noted that the design of frame 16 readily enables a better load bearing arrangement of the weight of a user by deployment of more of crosspieces 26 towards its center, where most of his weight must be supported, rather than their evenly spaced deployment along its length. The design also readily enables the varying of the hardness of bed 10 by simply adding crosspieces 26 to frame 16 or removing crosspieces 26 therefrom as required.

Figure 1C:
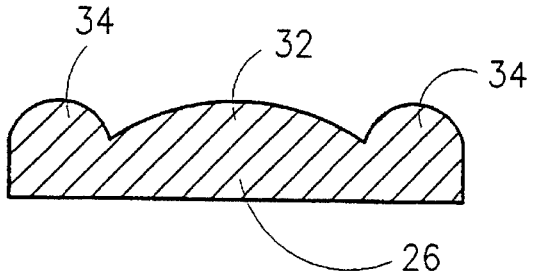
FIG. 1*c* shows a cross-section view of a crosspiece of the bed.

It is a particular feature of the present invention that, as best seen in FIG. 1*c*, crosspieces 26 have a generally convex shape 32, between two generally narrow arch-shaped end portions 34, which has been shown to have back pain alleviating properties.

Figure 1D:
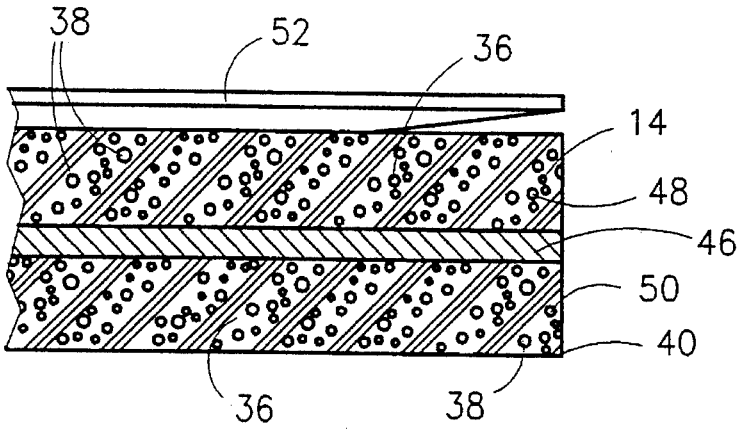
FIG. 1*d* shows a cross-section view of the mattress of the bed.

With reference now to FIG. 1*d*, it is particular feature of the present invention that mattress 14 preferably comprises a composite filling including a foam substrate 36 with a plurality of substantially incompressible marble-size balls 38 embedded therein enclosed by a covering 40 provided with a plurality of buckle-like devices 42 for adjusting the packing density of filling 36 to vary the hardness of mattress 14.

Coveting 40 is also preferably manufactured from washable, stretchable material and provided with a fastener 44, extending across the width thereof. Hence, covering 40 can readily cover more filling 36 or a material of different properties, for example, plyboard 46 inserted between two sheets 48 and 50 of filling 36 for the purpose of varying the hardness of mattress 14. Covering 40 can further be provided with a quilt 52.

It can be readily understood that bed 10 provides the user with several methods for varying the hardness and therefore corresponding degree of support provided by the base-mattress combination to take into account his changing personal circumstances, for example, aging, gaining weight etc. and to compensate for the wear and tear on the mattress.

In particular, the user can readily add more crosspieces to frame, remove crosspieces therefrom or alter the deployment of crosspieces to vary the hardness of the bed to more conveniently support his body. Alternatively, the user can vary the hardness of the mattress by adding more filling, inserting material of different properties, for example, plyboard, between two sheets of filling or adjusting the packing density of a composite filling having a foam substrate with a plurality of substantially incompressible marble-size balls embedded therein.

While the invention has been described with respect to a limited number of embodiments, it will be appreciated that many variations, modifications and other applications of the invention may be made.

What is claimed is:

1. A base for a bed comprising:

a) a generally rectangular frame;

b) a plurality of crosspieces traversing said frame, wherein the distribution of crosspieces can be varied to vary the hardness of the bed;

said frame including C-shaped frame members providing a recess for receiving the ends of said plurality of crosspieces;

each of said crosspieces having a cross-section consisting of a plurality of adjacent convex protrusions.

2. The base as in claim 1, wherein said frame members have a substantially planar inclined top face.

3. A bed comprising:

a) a base; and b) a mattress overlying said base; said base comprising:

a) a generally rectangular frame;

b) a plurality of crosspieces traversing said frame, wherein the distribution of crosspieces can be varied to vary the hardness of the bed;

said frame including C-shaped frame members providing a recess for receiving the ends of said plurality of crosspieces;

each of said crosspieces having a cross-section consisting of a plurality of adjacent convex protrusions.

4. A mattress for a bed comprising:

a) a filling which can be varied to vary the hardness of the mattress, said filling including a foam substrate with a plurality of substantially incompressible marble-size balls embedded therein; and b) a covering for covering said filling;

wherein the packing density of said filling can be varied to vary the hardness of the mattress.

5. The mattress as in claim 4, wherein the amount of said filling can be varied to vary the hardness of the mattress.

6. The mattress as in claim 4, wherein the components of said filling can be varied to vary the hardness of the mattress.

7. The mattress of claim 4, wherein said covering includes means for adjusting the packing density of said filling.

* * * * *